United States Patent [19]

Heitmann et al.

[11] 4,154,090

[45] May 15, 1979

[54] PROCESS AND APPARATUS FOR MULTIPLE TESTING OF WRAPPERS OF CIGARETTES OR THE LIKE

[75] Inventors: Uwe Heitmann, Schwarzenbek; Heinz-Christen Lorenzen, Hamburg; Günter Wahle, Reinbek; Rolf Dahlgrün, Schwarzenbek, all of Fed. Rep. of Germany

[73] Assignee: Hauni-Werke Körber & Co. KG, Hamburg, Fed. Rep. of Germany

[21] Appl. No.: 852,962

[22] Filed: Nov. 18, 1977

[30] Foreign Application Priority Data

Nov. 26, 1976 [DE] Fed. Rep. of Germany ..... 2653733

[51] Int. Cl.[2] ..... G01N 15/08

[52] U.S. Cl. ..... 73/38; 73/41; 73/45.1

[58] Field of Search ..... 73/38, 41, 45, 45.1, 73/45.2

[56] References Cited

U.S. PATENT DOCUMENTS

| | | | |
|---|---|---|---|
| 3,395,570 | 8/1968 | Kochalski | 73/38 X |
| 3,690,149 | 9/1972 | Pezzi | 73/38 |
| 3,991,605 | 11/1976 | Reuland | 73/38 |
| 4,018,081 | 4/1977 | Loxham | 73/41 |

*Primary Examiner*—Charles Gorenstein
*Attorney, Agent, or Firm*—Peter K. Kontler

[57] ABSTRACT

The wrappers of filter cigarettes wherein wrapper portions surrounding the filter mouthpieces have holes for admission of atmospheric air into the column of tobacco smoke are tested during sidewise movement at the periphery of a rotary drum. A first testing device establishes a first pressure differential between the interior and exterior of successive wrappers, and a second testing device establishes a second pressure differential between the interior and exterior of those wrapper portions which surround tobacco as well as a different third pressure differential between those wrapper portions which surround the filter material. An evaluating circuit has two electropneumatic transducers which furnish first and second signals respectively denoting the pressure differential between the interior and exterior of successive wrappers and the pressure differential between the interior and exterior of successive wrapper portions which surround tobacco. A subtracting circuit furnishes third signals which denote the difference between the first and second signals. The first and third signals are compared with reference signals which respectively denote maximum permissible permeability of wrappers and minimum acceptable permeability of successive wrapper portions surrounding the filter material. Cigarettes wherein the permeability of wrappers is outside of the range between the maximum permissible and minimum acceptable permeability are segregated from acceptable cigarettes.

32 Claims, 5 Drawing Figures

Fig.2
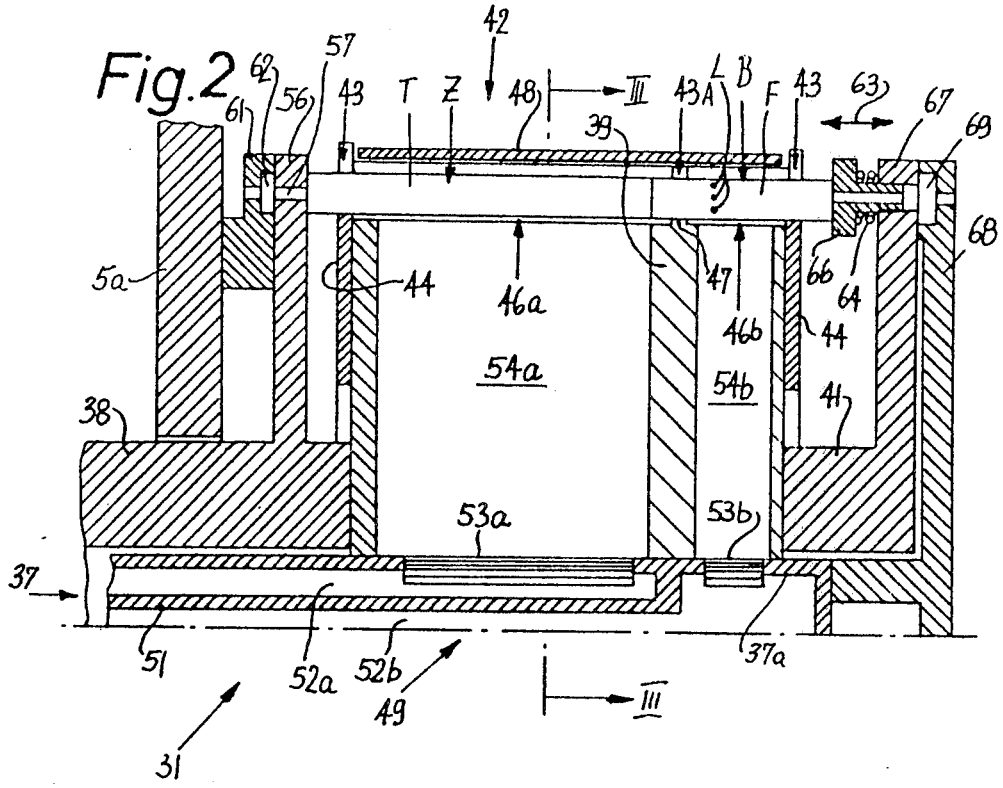
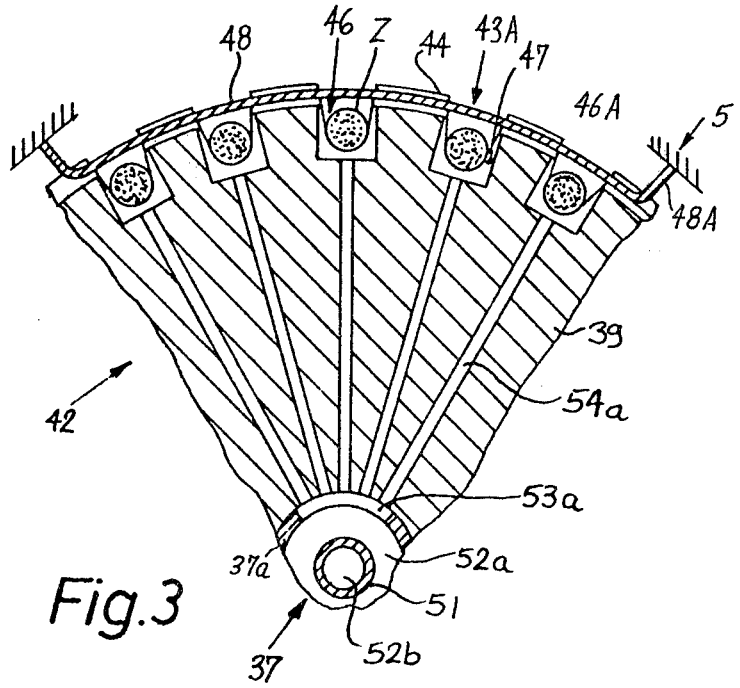
Fig.3

PROCESS AND APPARATUS FOR MULTIPLE TESTING OF WRAPPERS OF CIGARETTES OR THE LIKE

BACKGROUND OF THE INVENTION

The present invention relates to a process and apparatus for testing the wrappers of rod-shaped articles (including plain or filter-tipped cigarettes, cigars, cigarillos and cheroots as well as filter rod sections) which constitute or form part of smokers' products. More particularly, the invention relates to a process and apparatus for ascertaining the permeability of wrappers of rod-shaped articles (hereinafter referred to as cigarettes or filter cigarettes) of the type wherein each wrapper includes a portion of predetermined permeability so that it allows cool atmospheric air to enter the column of tobacco smoke flowing into the smoker's mouth.

It is already known to provide the wrappers of cigarettes with holes or perforations which admit cool atmospheric air into the column of tobacco smoke. The perforated portions of wrappers constitute the so-called climatic zones which are normally adjacent to unlighted ends of the cigarettes. For example, the wrapper of a filter cigarette will be provided with perforations in that portion which surrounds or is closely adjacent to the mouthpiece; this insures that cool atmospheric air will flow into the column of tobacco smoke regardless of the length of non-combusted portion of the tobacco-containing part of the smokers' product. Devices which can be used to perforate selected portions of wrappers of filter cigarettes or the like are disclosed in commonly owned copending applications Ser. Nos. 834,645 filed Sept. 19, 1977 by Heitmann et al., 841,108 filed Oct. 11, 1977 by Wahle et al., and 864,441 filed Dec. 27, 1977 by Lüders et al.

Many manufacturers of smokers' products demand that the machines which produce cigarettes, cigarillos or cigars be equipped with perforating devices so as to allow a predetermined quantity of atmospheric air to mix with tobacco smoke which flows toward the mouth. The admixture of atmospheric air to smoke is considered to be desirable because it is believed to reduce the health hazards involved in smoking of tobacco by controlling the amount of nicotine and condensates in the smoke. The packages for cigarettes or other smokers' products must bear information indicating the nicotine content, the tar content and the percentage of certain other ingredients, and the manufacturer is responsible for the accuracy of such information. One of the factors which influence the quantity of nicotine and condensates in the column of tobacco smoke is the quantity of admitted atmospheric air; therefore, it is important to insure that the quantity of admitted air will invariably equal or perhaps even slightly exceed a predetermined minimum acceptable value. Consequently, it is necessary to ascertain whether or not the combined cross-sectional area of perforations in the wrappers suffices to guarantee the admission of minimum required quantity of atmospheric air. Furthermore, it is desirable to ascertain the permeability of a finished wrapper (i.e., of the tubular wrapper of a filter cigarette or the like) because this is the only reliable mode of determining the permeability of perforated wrapper portions. For example, certain perforations can be clogged by particles of tobacco or filter material so that, even if the permeability of wrapping material ahead of the wrapping station is clearly adequate, the permeability of perforated portion of the finished wrapper will be too low.

Automatic testing of wrappers of cigarettes or the like for the presence of open seams, holes, frayed ends and/or other defects is known for nearly two decades. The first successful automatic testing apparatus is disclosed in commonly owned U.S. Pat. No. 3,408,858 to Heinz Kaeding. As a rule, one establishes a pressure differential between the interior and exterior of the wrapper. The pressure differential decreases when the wrapper is defective, e.g., due to the presence of a partly open seam. This is detected by a transducer which furnishes signals to a signal comparing stage (e.g., a threshold circuit) whch actuates an ejector when the intensity or another characteristic of the signal is indicative of a defective wrapper. The ejector segregates each defective article from satisfactory articles, for example, by directing streams of compressed air against the ends or sides of articles having unsatisfactory wrappers. Presently known testing apparatus are sufficiently accurate to effect the segregation of cigarettes or analogous rod-shaped articles having wrappers which are defective because their permeability exceeds the acceptable permeability by a value corresponding to that which is attributable to the presence of a hole with a diameter of approximately one millimeter. Deviations which are less pronounced cannot be ascertained with a requisite degree of accuracy and reproducibility because the results of tests are influenced by unavoidable factors such as unequal sealing of wrapper ends on successive articles during testing, deviation of density of the tobacco filler from an optimum value, wear upon moving parts of the testing apparatus, clogging of narrow passages in such apparatus by tobacco dust or other foreign matter and/or others. On the other hand, the increased permeability of intentionally perforated portions of wrappers of filter cigarettes or the like is less pronounced than that permeability which is attributable to the presence of a hole with a diameter of one millimeter. Moreover, it is desirable to insure that the permeability of intentionally perforated portions of the wrappers should not deviate from (above or below) optimum permeability by more than two percent.

OBJECTS AND SUMMARY OF THE INVENTION

An object of the invention is to provide a novel and improved process for ascertaining, with a high degree of accuracy, the permeability of wrappers of rod-shaped articles which constitute or form part of smokers' products and wherein predetermined portions of the wrappers must exhibit a predetermined permeability.

Another object of the invention is to provide a process which insures the detection of all articles whose wrappers exhibit excessive permeability (for example, due to the presence of large holes or open seams) as well as the detection of all articles wherein the permeability of intentionally perforated wrapper portions deviates, even very slightly, from an optimum value.

A further object of the invention is to provide a novel and improved process for multiple or repeated testing of wrappers of cigarettes or the like.

An additional object of the invention is to provide a process which allows for multiple testing of cigarettes or analogous rod-shaped articles at the rate at which such articles are produced or issue from a modern high-speed maker, e.g., a filter cigarette making machine which turns out up to and in excess of 70 filter cigarettes per second.

Still another object of the invention is to provide a novel and improved apparatus for the practice of the above outlined process.

A further object of the invention is to provide a compact and relatively simple but highly reliable testing apparatus which can be readily installed in existing makers of cigarettes or the like.

One feature of the invention resides in the provision of a process for testing the wrappers of cigarettes or analogous rod-shaped articles which constitute or form part of smokers' products. The process comprises the steps of moving a series of rod-shaped articles (preferably sideways) along a predetermined path (such path can be defined by one or more endless conveyors, e.g., rotary fluid drums), measuring the permeability of larger first portions of the wrappers of successive articles of the series including generating first signals (e.g., by means of a first electropneumatic transducer) which denote the permeability of the respective first wrapper portions (each such wrapper portion may constitute the entire wrapper of the respective article), measuring the permeability of smaller second portions of the wrappers of successive articles of the series including generating second signals (e.g., by means of a second electropneumatic transducer) which denote or represent the permeability of the respective second wrapper portions (each second wrapper portion forms part of the respective first wrapper portion), and utilizing the first and the corresponding second signals for the generation of third signals (e.g., by resorting to a suitable subtracting circuit) which denote or represent the difference between the intensities and/or other characteristics of the respective first and second signals and are indicative of permeability of the remaining parts of the first wrapper portions.

For example, if the articles are filter cigarettes, the first wrapper portions may constitute the entire wrappers, the second wrapper portions may constitute the wrappers of tabacco-containing portions (plain cigarettes) of the filter cigarettes, and the remaining parts of the first wrapper portions then constitute the wrappers of filter mouthpieces of the respective filter cigarettes. The wrappers of filter mouthpieces (i.e., the remaining parts of the first wrapper portions) are preferably provided with one or more holes in the course of a step which precedes the last mentioned measuring step. The hole or holes admit atmospheric air into the column of tobocco smoke.

The first mentioned measuring step may further include establishing a first pressure differential between the interior and exterior of successive first wrapper portions at a first testing station. Such pressure differential can be established by admitting atmospheric air into one end of each wrapper and by evacuating air from the space surrounding the respective wrapper. Alternatively, the first pressure differential can be established by admitting compressed testing fluid into both ends of each wrapper and by allowing the space around the wrapper to communicate with the atmosphere. The last mentioned measuring step then preferably further includes establishing a second pressure differential between the interior and exterior of successive second wrapper portions at a second testing station and simultaneously establishing a different third pressure differential between the interior and exterior of the remaining parts of the respective first wrapper portions. The second pressure differential may but need not equal or closely approximate the first pressure differential. As a rule, one (preferably the first mentioned) measuring step will precede the other measuring step.

The pressure at the exterior or interior of the remaining parts of successive first wrapper portions in the course of the first mentioned measuring step may deviate from the pressure at the exterior or interior of the remaining parts of first wrapper portions in the course of the last mentioned measuring step. The arrangement may be such that, in the course of the last mentioned measuring step, the pressure at the exterior of the remaining part of each first wrapper portion will exceed the pressure at the exterior of the respective second wrapper portion and/or the pressure at the exterior of the remaining part of the first wrapper portion in the course of the first measuring step. Alternatively, the pressure in the interior of the remaining part of a first wrapper portion (in the course of the first mentioned measuring step) may deviate from the pressure in the interior of the remaining part in the course of the last mentioned measuring step; the pressure in the interior of the remaining part in the course of the last mentioned measuring step may exceed the pressure in the interior of the same remaining part in the course of the first mentioned measuring step.

The third pressure differential may equal or closely approximate zero. This can be achieved, for example, by admitting compressed testing fluid into the remaining part and simultaneously admitting testing fluid or another fluid, at the same pressure, into the space surrounding the remaining part.

The process preferably further comprises the steps of respectively comparing the first and third signals with first and second reference signals which reference signals respectively denote the maximum permissible permeability of first wrapper portions and the minimum acceptable permeability of the respective remaining parts. The comparing step can be carried out by resorting to suitable threshold circuits or the like. Still further, the process may comprise the step or steps of expelling from the predetermined path those articles wherein the permeability of first wrapper portions exceeds the maximum permissible permeability and/or those articles wherein the permeability of remaining parts of the first wrapper portions is less than the minimum acceptable permeability.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged fragmentary axial sectional view of a conveyor which forms part of the testing apparatus, the section being taken in the direction of arrows as seen from the line II—II of FIG. 1;

FIG. 3 is a fragmentary transverse vertical sectional view as seen in the direction of arrows from the line III—III of FIG. 1;

DESCRIPTION OF THE PREFERRED EMBODIMENTS

Figure 1:
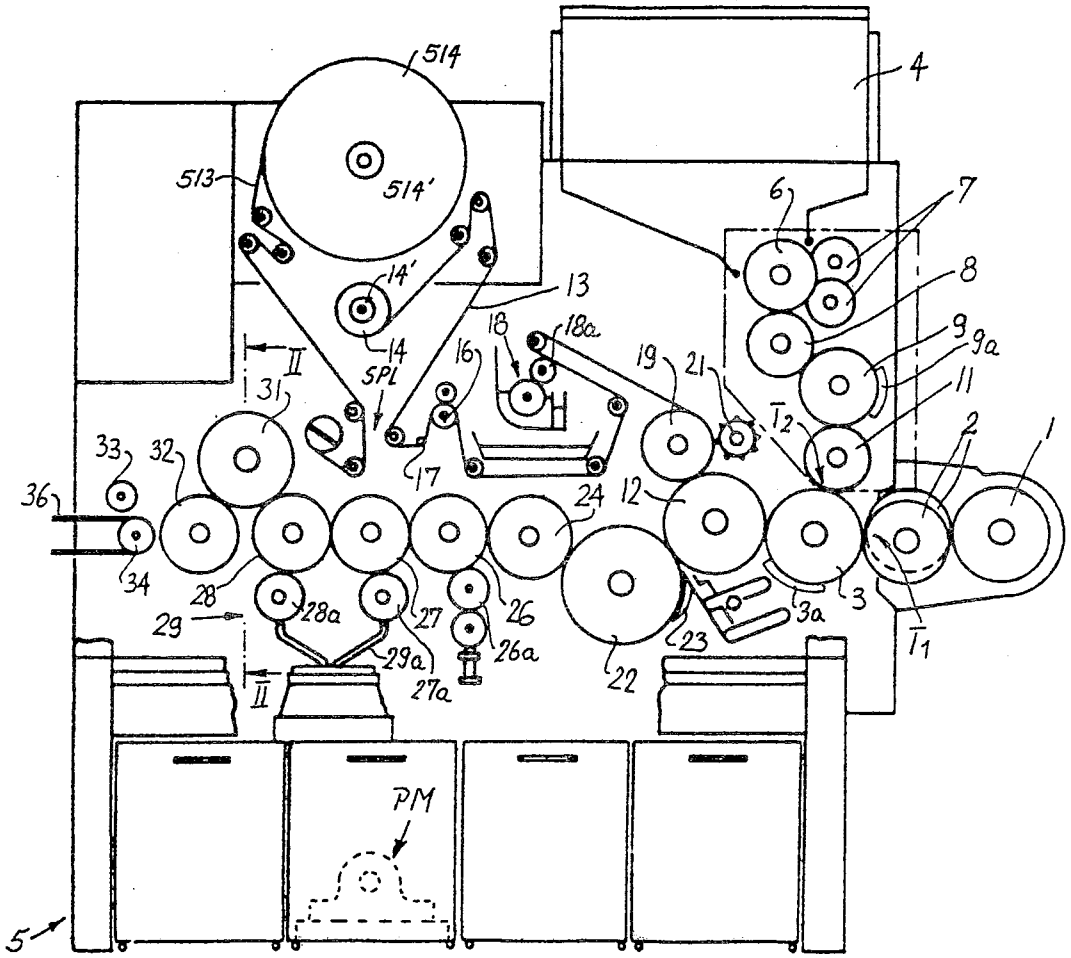
FIG. 1 is a schematic elevational view of a filter cigarette making machine including a testing apparatus which embodies one form of the invention.

FIG. 1 shows a filter cigarette making machine of the type known as MAX S (produced by the assignee of the present application). The machine is directly coupled to a maker of plain cigarettes of unit length, e.g., to a machine known as GARANT (trademark) produced by the assignee of the present application. The maker comprises a rotary drum-shaped row forming conveyor 1 which is mounted in or on the frame 5 of the filter cigarette making machine and has peripheral flutes for continuous delivery of two rows of plain cigarettes of unit length. The flutes of the conveyor 1 are parallel to its axis, i.e., the cigarettes are transported sideways. The cigarettes of one row are admitted into the oddly numbered flutes and the cigarettes of the other row are admitted into the evenly numbered flutes of the conveyor 1. Furthermore, the cigarettes of one row are adjacent to one axial end and the cigarettes of the other row are adjacent to the other axial end of the conveyor 1.

The filter cigarette making machine comprises a pair of rotary drum-shaped aligning conveyors 2 which are mounted in the frame 5 adjacent to the row forming conveyor 1 and have peripheral flutes for sidewise transport of plain cigarettes toward a transfer station T1. One of the conveyors 2 receives successive plain cigarettes of one row and the other conveyor 2 receives successive plain cigarettes of the other row. The conveyors 2 are driven at different speeds and/or transport the plain cigarettes of the respective rows through different distances so that each flute of a rotary drum-shaped assembly conveyor 3 which arrives at the transfer station T1 receives a pair of coaxial plain cigarettes of unit length. The plain cigarettes of each pair are separated from each other by a gap having a width which at least equals the length of a filter rod section or mouthpiece of double unit length.

The upper portion of the frame 5 supports a magazine 4 for filter rod sections of six times unit length. The outlet of the magazine 4 receives a portion of a rotary drum-shaped severing conveyor 6 having peripheral flutes which remove filter rod sections from the magazine 4 and transport them past two rotary disk-shaped knives 7 which are staggered with respect to each other, as considered in the axial and circumferential direction of the conveyor 6. The latter cooperates with the knives 7 to subdivide each filter rod section of six times unit length into sets of three coaxial filter rod sections of double unit length. The filter rod sections of each set are transferred into peripheral flutes of three rotary drum-shaped staggering conveyors 8 (only one shown) which rotate at different speeds and/or transport the respective filter rod sections through different distances to thereby stagger the sections in the circumferential direction of the illustrated conveyor 8. The staggering conveyors 8 deliver discrete filter rod sections of double unit length into successive flutes of a rotary drum-shaped shuffling conveyor 9 which cooperates with two stationary cams 9*a* to convert the filter rod sections into a single row wherein each preceding section is in exact register with the next-following section. Successive sections of the thus obtained row are delivered into successive flutes of a rotary drum-shaped accelerating conveyor 11 which deposits such sections into successive flutes of the assembly conveyor 3 at a second transfer station T2 preceding the station T1. Each inserted filter rod section of double unit length is positioned in such a way that it is flanked by two coaxial plain cigarettes of unit length after the respective flute of the conveyor 3 advances beyond the station T1. The thus obtained groups of three coaxial articles each (a filter rod section of double unit length and two plain cigarettes of unit length) are thereupon caused to move through the gap between two stationary condensing cams 3*a* which move the inner ends of the plain cigarettes into actual abutment with the respective ends of the coaxial filter rod section. The condensed groups are delivered into the flutes of a rotary drum-shaped transfer conveyor 12.

The frame 5 of the filter cigarette making machine further supports a spindle 14' for a roll 14 of convoluted wrapping material which constitutes an elongated web 13 consisting of cigarette paper, artificial cork or the like. The web 13 is drawn off the roll 14 by two advancing rolls 16 at least one of which is driven by the prime mover PM of the filter cigarette making machine and the other of which is preferably biased against the one roll. Successive increments of the web 13 are caused to pass along the relatively sharp edge of a curling device 17 of the type disclosed in commonly owned U.S. Pat. No. 3,962,957 granted June 15, 1976 to Alfred Hinzmann. The purpose of the curling device 17 is to eliminate and/or equalize internal stresses in the material of the web 13. One side of the running web 13 is coated with a suitable adhesive by the rotary applicator 18*a* of a paster 18 which is installed in the frame 5 downstream of the advancing rolls 16. The leader of the web 13 ahheres to the periphery of a rotary suction drum 19 which cooperates with a rotary knife 21 to subdivide the web 13 into a succession of discrete adhesive-coated uniting bands. Such bands are attached to successive groups of rod-shaped articles on the transfer conveyor 12, preferably in such a way that each band extends tangentially of the respective group and adheres to the respective filter rod section as well as to the inner end portions of the respective plain cigarettes.

A second spindle 514' supports a roll 514 consisting of convoluted wrapping material which constitutes an elongated web 513. The leader of the web 513 is located at a splicing station SPL which includes means for attaching the leader of the web 513 to the running web 13 when the diameter of the roll 14 is reduced to a predetermined minimum value. The device at the splicing station SPL may be of the type disclosed in commonly owned U.S. Pat. No. 3,586,006 granted June 22, 1971 to Gerd-Joachim Wendt.

Successive groups in the flutes of the transfer conveyor 12 (each such group carries a discrete uniting band) are delivered to a rotary drum-shaped wrapping conveyor 22 which cooperates with a stationary or mobile rolling device 23 to roll successive groups around their respective axes and to thus convert the respective uniting bands into tubes which sealingly surround the filter rod sections and the inner ends of plain cigarettes of the respective groups, i.e., each such group is converted into a filter cigarette of double unit length. The wrapping conveyor 22 delivers successive filter cigarettes of double unit length into the flutes of a rotary drum-shaped heating or drying conveyor 24 which insures that the adhesive on each tube sets prior to transfer into the flutes of a rotary drum-shaped severing conveyor 26 cooperating with a rotary disk-shaped knife 26*a* which severs each filter cigarette of double unit length midway across the tube so that such cigarettes yield pairs of coaxial filter cigarettes Z (FIG. 2) of unit length (hereinafter called cigarettes for short). Defective cigarettes (e.g., those without a filter plug or tobacco-containing portion) are ejected during travel along the periphery of the severing conveyor 26.

The conveyor 26 delivers pairs of cigarettes to the rotary drum-shaped conveyor 27 of a turn-around device 29 of the type disclosed in commonly owned U.S. Pat. No. 3,583,546 granted June 8, 1971 to Gerhard Koop. One cigarette of each pair is transferred onto a second conveyor 27*a* and is inverted through 180 degrees by one of several orbiting arms 29*a*. The other cigarettes of successive pairs are transferred into alternate flutes of a third rotary drum-shaped conveyor 28 of the device 29. A fourth conveyor 28*a* of the device 29 delivers inverted cigarettes into empty flutes of the conveyor 28 so that the inverted cigarettes are disposed between neighboring non-inverted cigarettes and the cigarettes form a single row wherein the filter mouthpieces of all cigarettes face in the same direction.

The conveyor 28 delivers successive cigarettes of the single row to a rotary drum-shaped conveyor 31 forming part of a testing apparatus wherein the cigarettes are monitored to ascertain whether or not their wrappers are satisfactory. Cigarettes having defective wrappers are segregated from satisfactory cigarettes during travel with a rotary drum-shaped conveyor 32 which is located downstream of the conveyor 31 and delivers satisfactory cigarettes onto the upper reach of a belt conveyor 36 trained over pulleys 34 (one shown). The illustrated pulley 34 cooperates with a rotary braking drum 33. The conveyor 36 delivers satisfactory cigarettes into storage, into chargers, to a pneumatic sender or directly into the magazine of a packing machine, not shown.

The conveyor 32 may be associated with a device which monitors the tobacco-containing ends of successive cigarettes Z and generates signals for ejection of cigarettes having unsatisfactory tobacco-containing ends. Such ejection can take place at the station for ejection of cigarettes having defective wrappers.

FIGS. 2 and 3 illustrate certain details of a testing apparatus which includes one embodiment of the conveyor 31 shown in FIG. 1. In many respects the testing apparatus which is used in the filter cigarette making machine of FIG. 1 operates (or can operate) in a manner known from presently used testing apparatus for rod-shaped articles which constitute or form part of smokers' products. The operation is based on the principle that one establishes a pressure differential between the interior and exterior of the wrapper and monitors the magnitude or extent of such pressure differential. The pressure can be higher in the interior of or around the wrapper, and the monitoring step can include measuring the rise of pressure at the lower-pressure side and/or measuring the drop of pressure at the higher-pressure side of the wrapper. As a rule, the testing fluid is air; however, it is clear that many other gases can be used with equal advantage. A suitable testing apparatus which can be used, with certain modifications, for the purposes of the present invention is disclosed in commonly owned U.S. Pat. No. 3,948,084 granted Apr. 6, 1976 to Bob Heitmann et al. to which reference may be had for all such details which are not fully shown in the drawing of the present application.

FIGS. 2 and 3 show a hollow shaft 37 which supports the components of the testing conveyor 31. Such components include three coaxial rotary members 38, 39 and 41 which together constitute a drum-shaped main body portion 42 of the conveyor. The means for transmitting torque from the prime mover PM to the main body portion 42 is of conventional design. The median rotary member 39 is flanked by two disks 44 whose peripheral portions define annuli of article-receiving cradles or sockets 43. Each socket 43 of the left-hand disk 44 of FIG. 2 is in register with a socket 43 of the right-hand disk 44. The conveyed articles are filter cigarettes Z of unit length; each such cigarette comprises a filter mouthpiece F of unit length and a plain cigarette T of unit length. These parts are sealingly secured to each other by one-half B of a convoluted uniting band which is obtained in response to severing of the web 13 in a manner as shown in FIG. 1. The rotary member 39 is formed with peripheral chambers or recesses 46 each of which is disposed between and aligned with two registering sockets 43. Still further, the rotary member 39 has an external ring 47 with an annulus of cradles 43A which receive the filter mouthpieces F in regions close to the adjacent inner ends of the plain cigarettes T. The cradles 43A can be said to constitute partitions which divide the respective chambers 46 into larger first and smaller second compartments 46*a* and 46*b*. The compartments 46*a* receive the major portions of plain cigarettes T and the compartments 46*b* receive portions of filter mouthpieces F of cigarettes Z in the respective chambers 46. The convoluted uniting bands or tubes B which surround the filter mouthpieces F and the adjacent inner end portions of plain cigarettes T have portions of desired permeability which is attributable to the provision of holes L adjacent to the right-hand side of the cradle 43A shown in FIG. 2. The manner in which the holes L can be formed in the material of the tubes B, either prior or subsequent to draping of uniting bands around the respective groups of coaxial articles, is disclosed, for example, in commonly owned copending application Ser. No. 841,108 of Wahle et al. and in commonly owned copending application Ser. No. 864,441 of Luders et al. Reference may be had to these commonly owned applications for details of the perforating devices which can be employed to provide the tubes B with predetermined portions of desired permeability. The application of Wahle et al. discloses that a perforating device may comprise needles, punching tools, spark generators and/or one or more lasers. Such device can be located between the roll 14 and drum 19 of FIG. 1 or adjacent to one of the conveyors which transport groups or rod-shaped articles, filter cigarettes of double unit length or filter cigarettes Z of unit length toward the conveyor 31. For example, a perforating device employing one or more sets of needles can be placed adjacent to the path of freshly formed filter cigarettes of double unit length on the wrapping conveyor 22 of FIG. 1.

The testing apparatus which includes the structure of FIGS. 2 and 3 further comprises an arcuate sealing element or shroud 48 which is disposed between the disks 44 and overlies the open outer ends of several neighboring chambers 46. The shroud 48 is secured (preferably pivoted) to the frame 5, as at 48A. The concave inner side of the shroud 48 is preferably closely adjacent to the projections 46A between neighboring chambers 46 of the rotary member 39 so that the compartments 46*a*, 46*b* which travel along the concave side of the shroud 48 are substantially sealed from the surrounding atmosphere. FIG. 3 shows that the width of gaps between the shroud 48 and the rotary member 39 is negligible.

The pressure of fluid in larger compartments 46*a* which travel along the concave inner side of the shroud 48 may but need not be different from the pressure of fluid in the associated smaller compartments 46*b*. The means 49 for maintaining the pressure in compartments 46*a*, 46*b* at desired levels includes an annular partition or wall 51 which is provided in and divides the interior of the shaft 37 into two discrete spaces 52*a* and 52*b*. The spaces 52*a*, 52*b* are connected with the suction intake of a blower or another suitable source 76 of compressed gas (see FIG. 4). The cylindrical outer wall 37*a* of the shaft 37 (which is stationary) has two relatively long slots 53*a* which are parallel to the axis of the shaft 37 and each of which establishes communication between the space 52*a* and a certain number (including one) of channels 54*a* machined into the rotary member 39. Each channel 54*a* communicates with a discrete compartment 46*a*. The outer wall 37*a* of the shaft 37 is further formed with at least one second slot 53*b* which is aligned with a slot 53*a* and connects the space 52*b* with a certain number (including one) of channels 54*b* also machined into the rotary member 39 and each communicating with a different compartment 46*b*. The illustrated arrangement is such that, when a compartment 46*a* communicates with the first space 52*a*, the aligned compartment 46*b* communicates with the space 52*b*.

The rotary member 38 has a ring-shaped flange 56 with holes 57 each of which is in register with a socket 43 in the adjacent disk 44. The flange 56 rotates with respect to a stationary valve plate 61 having two arcuate grooves 62 which communicate with successive bores 57 when the conveyor 31 rotates about the axis of the shaft 37. Each groove 62 receives atmospheric air (FIG. 4) or compressed testing fluid (FIG. 5). If the grooves 62 receive compressed testing fluid, they are connected with a suitable source, e.g., with the pressure outlet of the blower 176 shown in FIG. 5, so that such fluid penetrates into the interior of the wrappers of the cigarettes Z which advance past the grooves 62. The flange 56 seals the left-hand ends of the wrappers of cigarettes Z save for the relatively small regions which register with the respective holes 57. The valve plate 61 is biased against the outer side of the flange 56 to prevent uncontrolled escape of testing fluid from or uncontrolled admission of atmospheric air into the grooves 62. A member 5*a* of the frame 5 supports the valve plate 61 adjacent to the path of movement of the flange 56.

The rotary member 41 has a flange 67 which carries an annulus of reciprocable sealing elements 66 here shown as nipples which are biased by helical springs 64 so that they bear against the right-hand ends of wrappers of cigarettes Z on the conveyor 31. Each nipple 66 is in register with a socket 43 in the adjacent disk 44, and each such nipple is movable in directions indicated by the double-headed arrow 63. A suitable stationary cam (not specifically shown) is mounted in the frame 5 and cooperates with roller followers of the nipples 66 to retract the nipples ahead of the transfer station between the conveyors 28, 31 and again ahead of the transfer station between the conveyors 31, 32 so as to allow for unobstructed introduction of cigarettes Z into the respective sockets 43 and 43A. Once a cigarette Z enters the respective sockets, the cam allows the springs 64 to expand and to move the nipples 66 into sealing engagement with the adjacent ends of the wrappers of cigarettes Z; at the same time, the nipples 66 push the respective cigarettes Z against the flange 56. Alternatively, the nipples 66 can be moved by a wobble plate in a manner as disclosed in the aforementioned U.S. Pat. No. 3,948,084 to Heitmann et al.

Each illustrated nipple 66 has an axial passage which can admit compressed testing fluid into the respective end of the aligned wrapper. Such compressed fluid is admitted by one or two arcuate grooves 69 in a second stationary valve plate 69 which is outwardly adjacent to the flange 67. Each of the grooves 62, 69 can be connected with a device which measures the pressure of testing fluid and furnishes appropriate signals indicative of the measured pressure.

The grooves 69 in the valve plate 68 are necessary only in the testing apparatus of FIG. 5. If the apparatus is constructed in a manner as shown in FIG. 4, the grooves 69 are omitted and the nipples 66 can be replaced with nipples without axial passages for the flow of testing fluid, i.e., the nipples 66 then merely serve as a means for sealing the respective ends of the wrappers.

Figure 4:
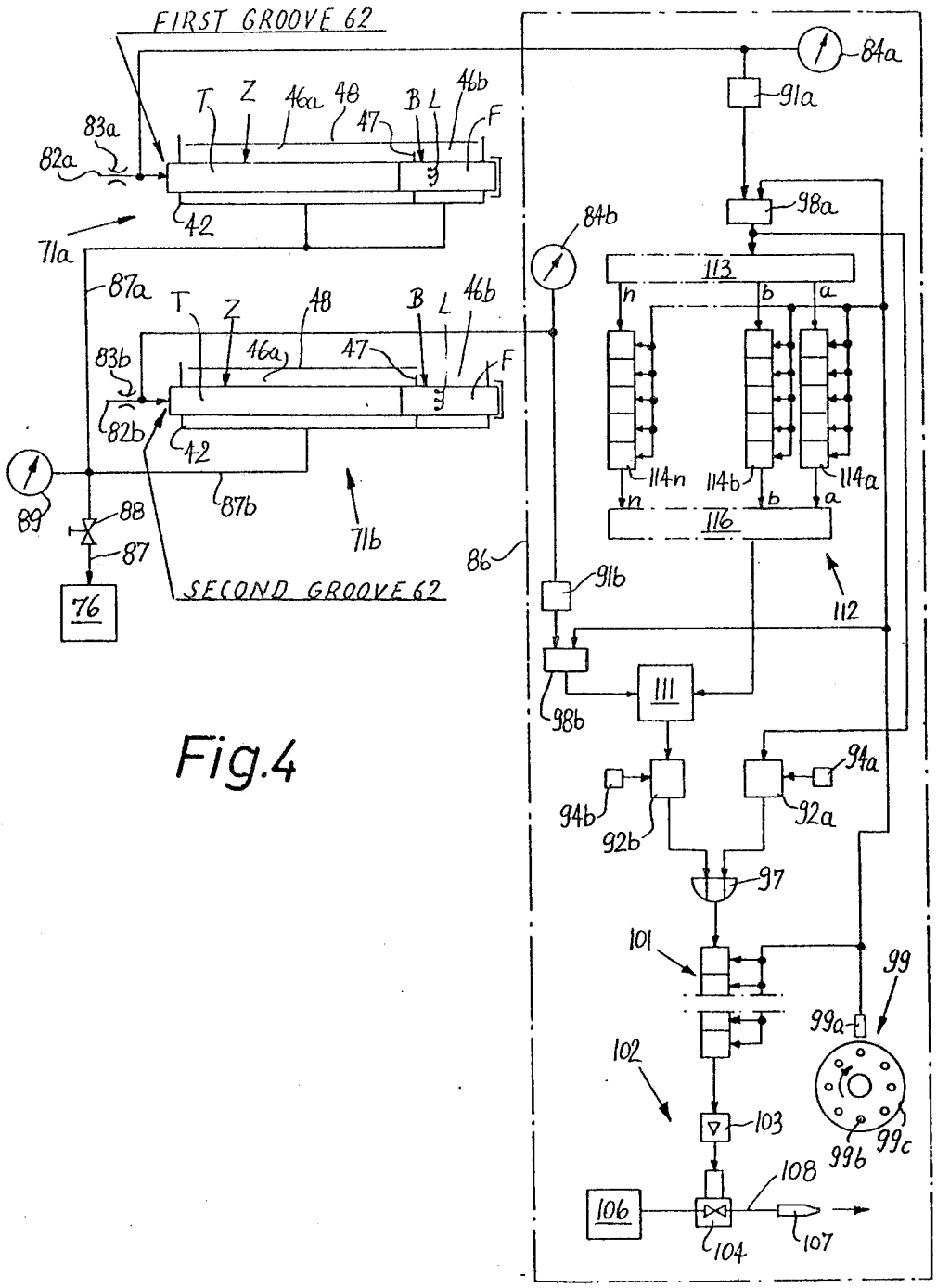
FIG. 4 is a diagrammatic view of the testing apparatus which includes one embodiment of the conveyor shown in FIGS. 2 and 3.
Figure 5:
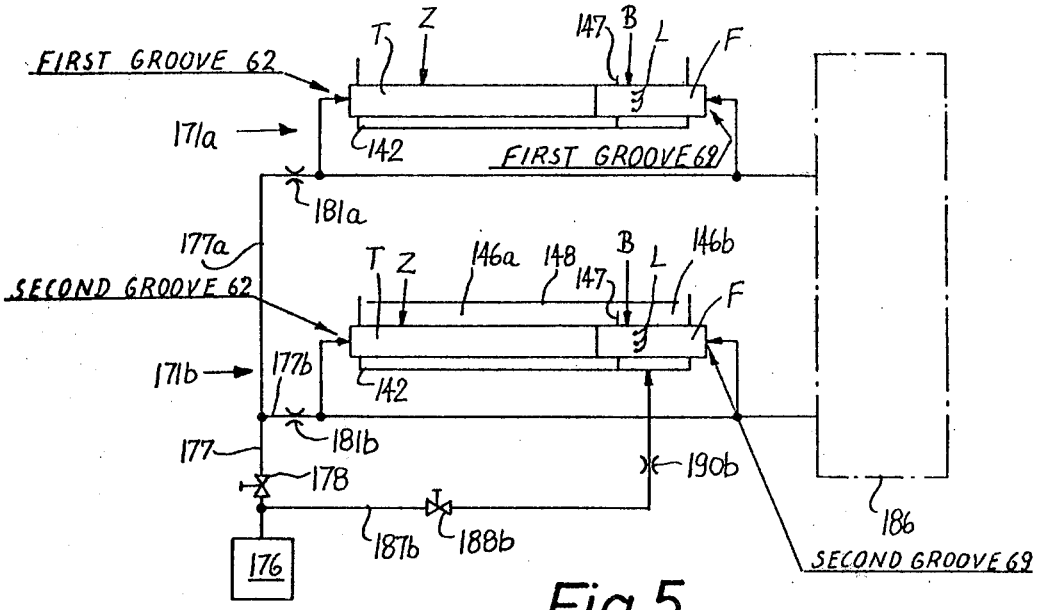
FIG. 5 is a similar diagrammatic view of a modified testing apparatus.

In the testing apparatus of FIG. 4, the valve plate 61 has two grooves 62 which are disposed one behind the other, as considered in the circumferential direction of the conveyor 31. Also, the wall 37*a* of the shaft 37 is then formed with two slots 53*a* (one for each groove 62) but with a single slot 53*b* (for the first groove 62). In other words, the apparatus of FIG. 4 is constructed in such a way that the suction intake of the blower 76 communicates with both compartments 46*a*, 46*b* of a chamber 46 when the latter is located in register with the first slot 62 but that only the compartment 46*a* will communicate with the suction intake of the blower 76 when the respective chamber 46 travels past the second groove 62.

Referring to FIG. 4 in detail, the suction intake of the blower 76 is connected with a pipe 87 containing a pressure regulating valve 88 and a pressure gauge 89 and having two branches 87*a* and 87*b*. The branch 87*a* forms part of a first testing device 71*a* of the apparatus of FIG. 4, and the branch 87*b* forms part of a second testing device 71*b*. The first testing device 71*a* facilitates measurement of the permeabiity of entire wrappers of successive cigarettes Z during travel past the first groove 62 of the valve plate 61, and the testing device 71*b* facilitates measurement of the permeability of predetermined (major) wrapper portions during travel of the respective wrappers past the second groove 62.

The branch 87*a* communicates with the compartments 46*a*, 46*b* of successive chambers 46, and the branch 87*b* communicates with successive compartments 46*a*. Thus, the branch 87*a* communicates with the first slot 53*a* and with the registering slot 53*b* whereas the branch 87*b* communicates solely with the second slot 53*a*. It will be realized that the representation of the apparatus of FIG. 4 is very schematic, i.e. that the branch 87*a* can be omitted if the pipe 87 communicates directly with the first slot 53*a* and with the registering slot 53*b* while a single branch (87*b*) of the pipe 87 communicates solely with the second slot 53*a*.

The first groove 62 of the valve plate 61 is connected with the discharge end of a pipe 82*a* whose inlet communicates with the atmosphere and which contains a preferably adjustable flow restrictor 83*a* and a pressure gauge 84a of high inertia, and is further connected with the input of an electropneumatic transducer 91a forming part of an evaluating circuit 86. The high-inertia pressure gauge 84a may be of the type known as encapsulated spring gauge, and the transducer 91a may be of the type disclosed in commonly owned U.S. Pat. No. 3,412,856 to Esenwein.

The second groove 62 of the valve plate 61 is connected to the discharge end of a pipe 82b whose inlet communicates with the atmosphere and which contains a preferably adjustable flow restrictor 83b and a pressure gauge 84b (which is preferably identical with the pressure gauge 84a). The pipe 82b is connected with the input of a second electropneumatic transducer 91b in the evaluating circuit 86.

The circuit 86 evaluates the electric signals which are furnished by the outputs of the transducers 91a and 91b. The output of the transducer 91a is connected with one input of an adjustable signal storing circuit 98a another input of which is connected with the proximity switch 99a of a pulse generator or synchronizing means 99 further having a rotary disk 99c provided with magnets 99b which travel past the switch 99a at the same rate at which successive cigarettes Z travel past the first and second grooves 62 of the valve plate 61. The disk 99c is driven by the prime mover PM of the filter cigarette making machine in synchronism with the conveyor 31. The output of the transducer 91b is connected with one input of a second adjustable signal storing circuit 98b whose other input is connected to the proximity switch 99a. The circuits 98a and 98b insure that signals furnished by the outputs of the transducers 91a and 91b are transmitted to additional parts of the evaluating circuit 86 at the exact moments when the corresponding wrappers respectively register with the first and second grooves 62 of the valve plate 61.

The outputs of the signal comparing circuits 98a, 98b are connected with the corresponding inputs of a subtracting circuit 111. The output of the circuit 98b is connected directly with the corresponding input of the circuit 111. On the other hand, the output of the circuit 98a is connected with the corresponding input of the circuit 111 by an adjustable time-delay unit 112 which insures that the two inputs of the circuit 111 receive, at the same time, signals generated by the transducers 91a, 91b during testing of one and the same wrapper. The unit 112 transports signals at the rate at which a wrapper advances from the first to the second groove 62 of the valve plate 61. To this end, the time-delay unit 112 comprises an analog-digital converter 113 whose input is connected with the output of the signal storing circuit 98a and which comprises several outputs a, b . . . n. Each of these outputs is connected with the first stage of a discrete shift register 114a, 114b . . . 114n. The shift registers 114a–114n receive signal transporting pulses from the proximity switch 99a of the pulse generator 99, and the last stages of these shift registers are connected to the corresponding inputs (a, b . . . n) of a digital-analog converter 116 whose output is connected with the right-hand input of the subtracting circuit 111. The number of stages in the shift registers 114a–114n corresponds to different distances between the grooves 62 of the valve plate 61. Only one shift register is active at any given time.

The output of the subtracting circuit 111 is connected with one input of a signal comparing threshold circuit 92b another input of which receives a reference signal from a suitable source 94b (e.g., an adjustable potentiometer). The output of the threshold circuit 92b transmits a signal when the intensity or another characteristic of the signal which is transmitted by the output of the subtracting circuit 111 is less pronounced than the corresponding characteristic of the reference signal from the source 94b.

The output of the signal storing circuit 98a is further connected with one input of a signal comparing threshold circuit 92a another input of which receives a reference signal from a source 94a. The output of the threshold circuit 92a transmits a signal when the intensity or another characteristic of the signal at the output of the circuit 98a exceeds the corresponding characteristic of the reference signal which is furnished by the source 94a.

The outputs of the threshold circuits 92a, 92b are connected with the corresponding inputs of an OR-gate 97 whose output is connected to the first stage of an additional shift register 101. The shift register 101 receives signal transporting pulses from the proximity switch 99a and its last stage is connected with the amplifier 103 of a segregating device 102 further including a normally closed solenoid-operated valve 104 in a conduit 108 connecting a source 106 of compressed air or another gas with an ejector nozzle 107. The latter is mounted adjacent to or in the conveyor 32 and serves to segregate defective cigarettes Z (i.e., cigarettes having defective wrappers) from satisfactory cigarettes by expelling the cigarettes with defective wrappers from that portion of the cigarette path which is defined by the conveyor 32. The shift register 101 insures that the signal which is transmitted by the output of the OR-gate 97 is transported toward the ejecting station at the speed of movement of the corresponding wrapper.

The high-inertia gauges 84a and 84b respectively furnish readings denoting the average permeability of several successive wrappers and several successive perforated wrapper portions.

The operation:

As soon as a chamber 46 reaches the concave inner side of the shroud 48, its compartments 46a, 46b are connected with the intake of the blower 76 by the pipe 87 and its branch 87a. In other words, the entire chamber 46 constitutes a suction chamber while the cigarette Z therein advances past the first testing device 71a. On the other hand, only the compartment 46a of a chamber 46 is connected with the intake of the blower 76 (via pipe 87 and branch 87b) while the corresponding cigarette Z travels past the second testing device 71b. The (subatmospheric) pressure in the compartments 46a, 46b which register with the first groove 62 is the same as the pressure in the compartment 46a which registers with the second groove 62. It is presently preferred to connect successive second compartments 46b with the atmosphere during travel past the second groove 62; this can be achieved by removing that portion of the shroud 48 which would overlie successive compartments 46b during travel past the second groove 62.

The signal storing circuit 98a accepts a signal from the transducer 91a only when it receives a signal from the proximity switch 99a. The intensity of (first) signal which is transmitted by the transducer 91a is indicative of permeability of a first wrapper portion, namely the entire wrapper, of a cigarette Z which registers with the first groove 62. If the measured permeability of the entire wrapper exceeds a predetermined maximum permissible permeability (denoted by the reference signal which is furnished by the source 94a), e.g., because that (second) portion of the wrapper which forms part of the plain cigarette T has an open seam, one or more relatively large holes, a frayed end or a combination of such defects and/or because the combined cross-sectional area of holes L in the wrapper portion of the filter mouthpiece F (remaining part of the wrapper) is excessive, the output of the threshold circuit 92*a* transmits a signal to the OR-gate 97 with the result that the corresponding cigarette Z is ejected from the respective flute of the conveyor 32 during travel past the orifice of the nozzle 107.

The output of the signal storing circuit 98*a* transmits each (first) signal from the transducer 91*a* to the analog-digital converter 113 of the time-delay unit 112. The latter delays the transmission of such signal to the corresponding input of the subtracting circuit 111 until the respective cigarette Z reaches the second groove 62 of the valve plate 61, i.e., until the respective cigarette enters the second testing device 71*b*. The signal which is transmitted by the output of the transducer 91*b* denotes the permeability of that (second) portion of a wrapper which forms part of the respective plain cigarette T, i.e., of a wrapper portion which forms part of the first wrapper portion (constituting the entire wrapper); therefore, the signal at the output of the subtracting circuit 111 denotes the permeability of wrapper portions (remaining parts of first wrapper portions) which are provided with the holes L, i.e., the permeability of wrapper portions forming part of the filter mouthpieces F. It can be said that the signal at the output of the subtracting circuit 111 denotes the combined cross-sectional area of holes L and hence the rate at which the respective wrapper can admit atmospheric air into the column of tobacco smoke. It has been found that signals at the output of the circuit 111 reflect the permeability of perforated wrapper portions with a surprisingly high degree of accuracy. This is attributed to the fact that the principle of operation of testing device 71*a* is identical to that of the device 71*b* so that eventual errors in the course of first testing operation are compensated for by similar errors in the course of the second testing operation and the (third) signals at the output of the subtracting circuit 111 are truly indicative of permeability of the perforated wrapper portions, i.e., of remaining parts of first wrapper portions.

The first testing device 71*a* establishes a first pressure differential between the exterior (chamber 46) and interior of successive wrappers, and the second testing device 71*b* establishes a second pressure differential between the exterior (compartment 46*a*) and interior of the wrapper portion which forms part of the plain cigarette T as well as a third pressure differential between the exterior (compartment 46*b*) and interior of the remaining part of the wrapper, namely, the wrapper portion forming part of the filter mouthpiece F. In the apparatus of FIG. 4, the first pressure differential may but need not equal the second pressure differential but the third pressure differential is different from the first and second pressure differentials. Thus, the pressure in the compartment 46*b* which registers with the first groove 62 of the valve plate 61 is different from the pressure in compartment 46*b* which registers with the second groove 62.

The output of the subtracting circuit 111 transmits (third) signals to the threshold circuit 92*b* and the latter compares such signals with the reference signal from the source 94*b*. If the intensity of signals at the output of the circuit 111 is less pronounced than the intensity of reference signal from 94*b*, the permeability of perforated wrapper portion of the respective wrapper is less than a minimum acceptable permeability and the threshold circuit 92*b* transmits a signal to the OR-gate 97 whereby such signal serves to effect expulsion of the corresponding cigarette Z during travel past the orifice of the nozzle 107.

It is clear that the testing apparatus of FIG. 4 can be modified in a number of ways without departing from the spirit of the invention. For example, the testing device 71*a* can be installed adjacent to that portion of the cigarette path which is defined by a first conveyor and the testing device 71*b* can be mounted adjacent to a second portion of the path which second portion is defined by a discrete second conveyor. Furthermore, the testing device 71*b* can be placed ahead of the testing device 71*a*; the time-delay unit 112 is then connected between the transducer 91*b* or signal storing circuit 98*b* and the signal storing circuit 98*b* or subtracting circuit 111.

FIG. 5 shows a portion of a second testing apparatus wherein all such parts which are identical with or clearly analogous to corresponding parts of the apparatus of FIG. 4 are designated by similar reference characters plus 100. The main difference is that the testing device 171*a* admits compressed testing fluid into both ends of a wrapper between the first groove 62 and the first groove 69 whereas the second testing device 171*b* admits compressed testing fluid into both ends of a wrapper between the second grooves 62, 69 as well as into the corresponding compartment 146*b*. The evaluation of pneumatic signals by the circuit 186 is analogous to that by the evaluating circuit 86 except that the signals have different signs. Thus, the pressure at the inputs of the transducers 91*a*, 91*b* in the circuit 86 of FIG. 4 is below atmospheric whereas the pressure of signals which are transmitted to the transducers of the circuit 186 is above atmospheric pressure.

The blower 176 has a pressure outlet which is connected with a pipe 177 containing a pressure regulating valve 178 and having branches 177*a*, 177*b* which respectively contain preferably adjustable flow restrictors 181*a*, 181*b*. The branch 177*a* admits compressed testing fluid to the first grooves 62, 69 and the branch 177*b* admits compressed testing fluid to the second grooves 62, 69. The pipe 177 has a further branch 187*b* containing a pressure regulating valve 188*b* and a preferably adjustable flow restrictor 190*b* and is connected with the compartments 146*b* of successive chambers during travel between the second grooves 62 and 69.

The compartments which travel through the first testing device 171*a* communicate with the atmosphere; this can be readily achieved by the simple expedient of shortening the shroud 148 so that it does not overlie the chambers between the first grooves 62 and 69. The branch 177*a* is further connected with that transducer of the circuit 186 which corresponds to the transducer 91*a* of FIG. 4. The branch 177*b* is further connected with the other transducer of the circuit 186. The testing device 171*a* facilitates measurement of the permeability of entire wrappers and the testing device 171*b* facilitates measurement of the permeability of wrapper portions which form part of the respective plain cigarettes T.

The aforementioned branch 187*b* communicates with successive second compartments 146*b* by way of the space 52*b* in the shaft 37 (not shown in FIG. 5). The adjustment of regulating valve 188*b* is such that the pressure in the compartment 146*b* which moves through the second testing device 171*b* equals or closely approximates the pressure of testing fluid which is admitted by the branch 177*b* into the right-hand end of the wrapper, as viewed in FIG. 5. Therefore, the pressure differential between the interior and exterior of a perforated wrapper portion in the testing device 171*b* is zero and the testing fluid can flow only from the interior of the other wrapper portion into the compartment 146*a* which communicates with the atmosphere. Some testing fluid will escape through the (second) wrapper portion surrounding the plain cigarette T because, as a rule, the wrapping material (cigarette paper) exhibits at least some porosity. The (third) signal which is transmitted by the subtracting circuit of the measuring circuit 186 is again indicative of permeability of the wrapper portions which are provided with holes L.

The testing apparatus of FIG. 5 can be readily converted for operation in a manner as described in FIG. 4 or vice versa. All that is necessary is to change the connections to the compartments of chambers in the testing conveyor, to replace the valve plate 61 and to replace the nipples 66 with different nipples or to seal the passages of the nipples 66.

An important advantage of the improved process and apparatus is that repeated testing of successive wrappers (in such a way that one testing operation is influenced and the other testing operation is not influenced by the presence of holes L) insures a highly accurate determination of permeability of perforated wrapper portions and hence of the amount of atmospheric air which can flow into the corresponding wrappers when the respective cigarettes are lighted. It has been found that the improved process and apparatus insure that the packing machine receives only those cigarettes wherein the permeability of perforated wrapper portions equals or very closely approaches the desired permeability. Moreover, factors which normally affect the accuracy of testing operations are eliminated in view of repeated testing of each wrapper in accordance with the same principle; this will be readily appreciated by taking into consideration that the measuring circuit 86 or 186 comprises a subtracting circuit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A process for testing the wrappers of cigarettes or analogous rod-shaped articles which constitute or form part of smokers' products, comprising the steps of moving a series of rod-shaped articles along a perdetermined path; measuring the permeability of larger first portions of the wrappers of successive articles of said series including generating first signals which denote the permeability of the respective first wrapper portions; measuring the permeability of smaller second portions of the wrappers of successive articles of said series including generating second signals which denote the permeability of the respective second wrapper portions, each second wrapper portion forming part of the respective first wrapper portion; and utilizing said first and the corresponding second signals for the generation of third signals which denote the difference between the respective first and second signals and are indicative of permeability of the remaining parts of said first wrapper portions.

2. A process as defined in claim 1, wherein said remaining parts of said first wrapper portions have air admitting holes therein.

3. A process as defined in claim 1, wherein said first mentioned measuring step further includes establishing a first pressure differential between the interior and exterior of successive first wrapper portions, said last mentioned measuring step further including establishing a second pressure differential between the interior and exterior of successive second wrapper portions and simultaneously establishing a different third pressure differential between the interior and exterior of the remaining parts of the respective first wrapper portions.

4. A process as defined in claim 3, wherein one of said measuring steps precedes the other of said measuring steps.

5. A process as defined in claim 3, wherein said moving step includes transporting the rod-shaped articles of said series in a direction transverse to the axes of the rod-shaped articles.

6. A process as defined in claim 3, wherein said first pressure differential matches or closely approximates said second pressure differential.

7. A process as defined in claim 3, wherein the pressure at the exterior of said remaining parts in the course of said first mentioned measuring step deviates from the pressure at the exterior of said remaining parts in the course of said last mentioned measuring step.

8. A process as defined in claim 3, wherein the pressure at the exterior of said remaining part exceeds the pressure at the exterior or said second wrapper portion in the course of said last mentioned measuring step.

9. A process as defined in claim 3, wherein the pressure in the interior of said remaining part in the course of said first mentioned measuring step deviates from the pressure in the interior of said remaining part in the course of said last mentioned measuring step.

10. A process as defined in claim 9, wherein the pressure in the interior of said remaining part in the course of said last mentioned measuring step exceeds the pressure in the interior of said remaining part in the course of said first mentioned measuring step.

11. A process as defined in claim 3, wherein said third pressure differential equals or closely approximates zero.

12. A process as defined in claim 1, further comprising the steps of respectively comparing said first and third signals with first and second reference signals which respectively denote the maximum permissible permeability of said first wrapper portions and the minimum acceptable permeability of the respective remaining parts.

13. A process as defined in claim 12, further comprising the step of expelling from said path those articles wherein the permeability of said first wrapper portions exceeds said maximum permissible permeability.

14. A process as defined in claim 12, further comprising the step of expelling from said path those articles wherein the permeability of the remaining parts of said first wrapper portions is less than said minimum acceptable permeability.

15. A process as defined in claim 1, wherein said first wrapper portions constitute the entire wrappers of the respective articles.

16. A process as defined in claim 15, wherein said articles are filter cigarettes and said second wrapper portions constitute the wrappers of tobacco-containing portions of the respective filter cigarettes, said remaining parts constituting the wrappers of filter mouthpieces of the respective filter cigarettes and each such remaining part having at least one hole for admission of atmospheric air into the column of tobacco smoke.

17. Apparatus for testing the wrappers of cigarettes or analogous rod-shaped articles which constitute or form part of smokers' products, comprising means for moving a series of articles along a predetermined path; a first testing device adjacent to said path and including means for establishing a first pressure differential between the interior and exterior of first portions of wrappers of the articles of said series; a second testing device adjacent to said path and including means for establishing a second pressure differential between the interior and exterior of second portions of wrappers of the articles of said series, each second wrapper portion forming part of the respective first wrapper portion; and evaluating means including means for generating first signals denoting the pressure differential between the interior and exterior of successive first wrapper portions, means for generating second signals denoting the pressure differential between the interior and exterior of successive second wrapper portions, and means for generating third signals denoting the difference between successive first signals and the respective second signals.

18. Apparatus as defined in claim 17, wherein one of said testing devices is located ahead of the other of said testing devices, as considered in the direction of movement of articles along said path.

19. Apparatus as defined in claim 18, wherein said moving means includes endless conveyor means having means for moving the rod-shaped articles of said series in a direction transverse to the axes of the rod-shaped articles.

20. Apparatus as defined in claim 18, wherein said evaluating means further comprises time-delay means interposed between the means for generating signals denoting the pressure differential which is established by said one testing device and said means for generating said third signals.

21. Apparatus as defined in claim 20, wherein said one testing device is said first testing device.

22. Apparatus as defined in claim 20, wherein said second testing device further includes means for establishing a different third pressure differential between the interior and exterior of remaining parts of successive first wrapper portions, each such remaining part having at least one air admitting hole.

23. Apparatus as defined in claim 22, wherein the mode of operation of said means for establishing said second pressure differential is identical with the mode of operation of said means for establishing said first pressure differential.

24. Apparatus as defined in claim 22, wherein said first and second testing devices further include means for maintaining the pressure at the exterior of said remaining parts at a first value in said first portion and at a second value in said second portion of said path.

25. Apparatus as defined in claim 24, wherein said means for establishing said pressure differentials comprises article-receiving chambers provided on said moving means, means for subdividing said chambers into first and second compartments, each first compartment receiving said second portion of the respective wrapper and each second compartment receiving the remaining part of the respective first wrapper portion, a source of testing fluid, means for connecting said source with said compartments to establish said first pressure differential, and means for connecting said source with said first compartments to establish said second pressure differential.

26. Apparatus as defined in claim 22, wherein said means for establishing said first pressure differential includes means for maintaining the interior of the remaining part of the wrapper at a first pressure and said means for establishing said third pressure differential includes means for maintaining the interior of said remaining part at a different second pressure.

27. Apparatus as defined in claim 26, wherein said last mentioned means includes means for maintaining the exterior of the remaining part at said second pressure.

28. Apparatus as defined in claim 17, wherein said evaluating means further comprises means for comparing said first signals with a first reference signal denoting the maximum permissible permeability of the respective first wrapper portions and means for comparing said third signals with a second reference signal denoting the minimum acceptable permeability of the remaining parts of the respective first wrapper portions.

29. Apparatus as defined in claim 28, wherein said means for generating said first signals includes a first electropneumatic transducer and said means for generating said second signals comprises a second electropneumatic transducer, said first mentioned comparing means including a first threshold circuit connected with the output of said first transducer and said last mentioned comparing means including a second threshold circuit having an input arranged to receive said third signals.

30. Apparatus as defined in claim 29, wherein said means for generating said third signals includes a subtracting circuit having an output connected with the input of said second threshold circuit.

31. Apparatus as defined in claim 28, further comprising means for expelling from said path those articles wherein the permeability of first wrapper portions exceeds said maximum permissible permeability.

32. Apparatus as defined in claim 28, further comprising means for ejecting from said path those articles wherein the permeability of the remaining parts of said first wrapper portions is less than said minimum acceptable permeability.

* * * * *